US012789107B2

(12) United States Patent
Sweed

(10) Patent No.: US 12,789,107 B2
(45) Date of Patent: Nov. 10, 2026

(54) GROUND LAUNCH STRIKE FLIGHT GLIDER WITH AUGMENTED PROPULSORY FEATURES

(71) Applicant: James Ray Sweed, Richmond, TX (US)

(72) Inventor: James Ray Sweed, Richmond, TX (US)

( * ) Notice: Subject to any disclaimer, the term of this patent is extended or adjusted under 35 U.S.C. 154(b) by 252 days.

(21) Appl. No.: 18/634,942

(22) Filed: Apr. 14, 2024

(65) Prior Publication Data

US 2025/0319417 A1 Oct. 16, 2025

(51) Int. Cl.

| | |
|---|---|
| ***A63H 27/00*** | (2006.01) |
| ***A63H 23/10*** | (2006.01) |
| ***A63H 23/12*** | (2006.01) |
| ***A63H 27/14*** | (2006.01) |

(52) U.S. Cl.

CPC ..... *A63H 27/14* (2013.01); *A63H 23/12* (2013.01)

(58) Field of Classification Search

CPC ..... A63H 23/10; A63H 23/12; A63H 27/00; A63H 27/001; A63H 27/14; A63H 33/00; A63H 33/18; B63B 22/57

USPC ..... 446/61, 64, 65, 66, 68, 153; 441/65; 244/16

See application file for complete search history.

(56) References Cited

U.S. PATENT DOCUMENTS 2,364,498 A * 12/1944 Walker ..... A63H 27/005 446/68
2,724,211 A * 11/1955 Bloom ..... A63H 27/001 446/66
2,791,867 A * 5/1957 Dasher ..... A63H 33/003 446/92
2,979,287 A * 4/1961 Ross ..... B64C 3/46 244/219
2,993,297 A * 7/1961 Bednar ..... A63H 27/005 124/64
3,022,966 A * 2/1962 Briggs ..... A63H 27/08 446/61
3,187,460 A * 6/1965 Robertson ..... A63H 27/00 446/61
3,225,488 A * 12/1965 Goldfarb ..... A63H 27/10 446/224
3,246,425 A * 4/1966 Miller ..... A63H 27/00 446/61
3,733,737 A * 5/1973 Goodman ..... A63H 27/00 446/68
3,763,972 A * 10/1973 Karzmar ..... A45C 9/00 383/110
3,898,763 A * 8/1975 Rizzo ..... A63H 27/00 446/68
3,909,976 A * 10/1975 Kirk ..... A63H 33/18 446/61

(Continued)

FOREIGN PATENT DOCUMENTS

CN 101879377 A * 11/2010

*Primary Examiner* — Alexander R Niconovich

(57) ABSTRACT

A glider toy principally of the kick-glider genre adapted to ground launch into free flight by a user provided impact force to a rearwardly confined or linearly mobile impact surface with the main body structure configured similar to that of an aquatic water board such as the common kick-board with flat-tending surfaces contoured to impart a lift force actuated by translational velocity employing both hydrodynamic and aerodynamic principles.

20 Claims, 14 Drawing Sheets

(56) References Cited

U.S. PATENT DOCUMENTS 3,918,197 A * 11/1975 Stanzel ..... A63H 27/14 446/65
4,033,070 A * 7/1977 Strongin ..... A63H 27/00 446/68
4,109,411 A * 8/1978 Wetherell ..... A63H 27/00 446/61
4,332,103 A * 6/1982 Shulman ..... A63H 27/00 446/64
4,411,249 A * 10/1983 Fogarty ..... A63H 27/14 124/64
4,512,690 A * 4/1985 Johnson ..... A63H 27/00 446/61
4,642,062 A * 2/1987 Dorffler ..... A63H 27/00 446/68
4,850,913 A * 7/1989 Szabad, Jr. ..... B63B 32/57 280/18
5,019,007 A * 5/1991 Miller ..... A63H 27/00 446/62
5,067,922 A * 11/1991 McMahon ..... B65D 81/3886 446/61
5,078,639 A * 1/1992 Kippen ..... A63H 27/00 446/61
5,090,636 A * 2/1992 Sadowski ..... B64C 39/10 D12/333
5,167,551 A * 12/1992 Davis ..... A63B 31/04 D21/807
5,176,559 A * 1/1993 Lane ..... A63H 27/00 446/61
5,240,448 A * 8/1993 Ishikawa ..... A63H 27/14 446/64
5,269,514 A * 12/1993 Adler ..... A63B 43/002 273/DIG. 20
5,275,860 A * 1/1994 D'Luzansky ..... B63B 32/22 441/74
5,281,179 A * 1/1994 Wu ..... A63H 27/14 446/61
5,364,299 A * 11/1994 Hill ..... A63H 18/002 446/61
5,383,805 A * 1/1995 Tsai ..... A63H 27/00 446/68
5,669,803 A * 9/1997 Sweed ..... A63H 33/18 446/61
5,846,112 A * 12/1998 Baker ..... A63H 27/14 446/64
5,863,250 A * 1/1999 Harris ..... A63H 33/185 473/569
5,908,341 A * 6/1999 dasa ..... A63H 27/00 446/61
6,105,903 A * 8/2000 Chen ..... A63H 27/08 446/61
6,139,392 A * 10/2000 Walker ..... A63H 27/00 446/61
6,328,622 B1 * 12/2001 Geery ..... A63H 23/10 244/96
6,435,932 B1 * 8/2002 Lynn ..... A63H 27/00 446/61
6,450,852 B1 * 9/2002 Arredondo ..... A63H 27/00 446/61
7,029,349 B2 * 4/2006 Lin ..... B63B 32/57 441/74
7,063,769 B2 * 6/2006 Cheung ..... B32B 37/10 441/74
7,261,050 B2 * 8/2007 Brauers ..... B63B 32/57 441/74
7,261,611 B1 * 8/2007 Smith ..... A63H 23/10 446/160
7,368,031 B2 * 5/2008 Lehr ..... B32B 27/32 156/263
7,503,826 B2 * 3/2009 Howard ..... A63H 27/001 446/61
D590,470 S * 4/2009 Mun ..... D21/769
8,388,402 B2 * 3/2013 Fielding, Jr. ..... A63H 23/10 446/153
8,403,778 B2 * 3/2013 Wallach ..... A63B 43/002 473/613
8,764,506 B2 * 7/2014 Vanderbeek ..... A63H 27/007 446/68
8,882,553 B2 * 11/2014 Hanrahan ..... B63B 32/20 441/65
9,808,690 B1 * 11/2017 Hurst ..... A63B 67/06
10,279,276 B2 * 5/2019 Geery ..... A63H 23/10
10,569,184 B2 * 2/2020 Middleton ..... A63H 29/00
2006/0292958 A1 * 12/2006 Sun ..... A63H 27/14 446/268
2007/0141944 A1 * 6/2007 Abeshouse ..... A63H 27/14 446/34
2015/0231519 A1 * 8/2015 Tsai ..... A63H 27/14 446/429

* cited by examiner

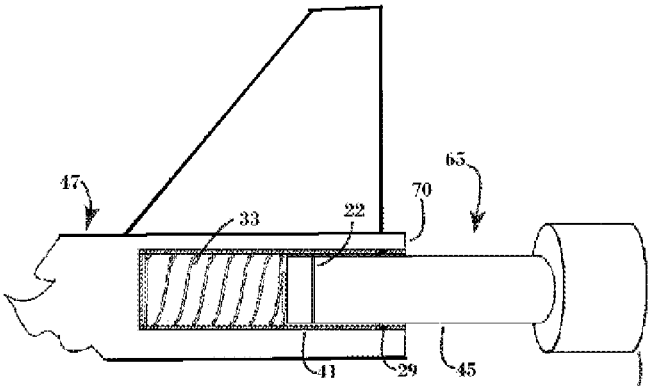
FIG. 23
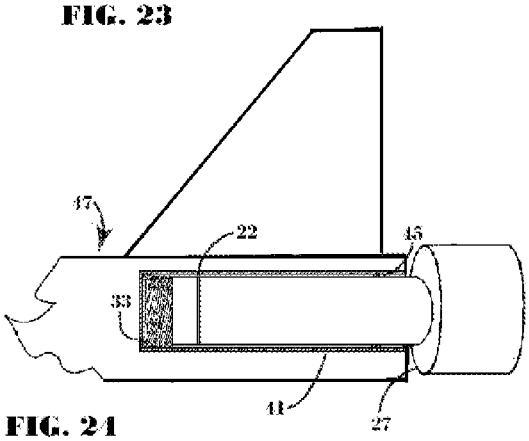
FIG. 24
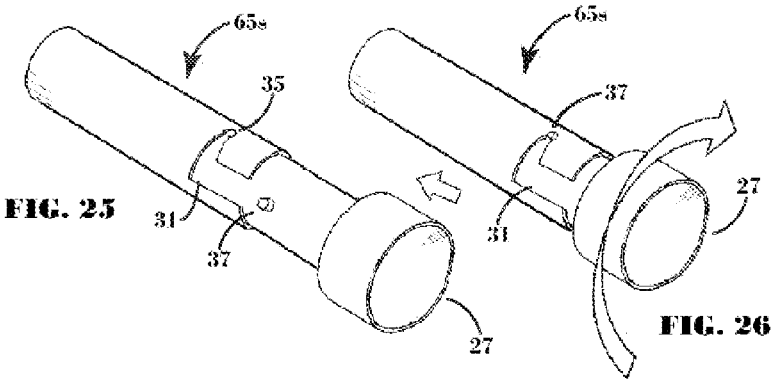
FIG. 25
FIG. 26

GROUND LAUNCH STRIKE FLIGHT GLIDER WITH AUGMENTED PROPULSORY FEATURES

CROSS-REFERENCE TO RELATED APPLICATIONS

This is a continuation-in-part of U.S. patent application Ser. No. 16/890,003, filed Jun. 2, 2020 whose entire disclosure is incorporated by this reference as though set forth fully herein.

BACKGROUND

Field of the Invention

The present invention relates to free flight thrust initiated gliders and more specifically to a glider structure having a number of structural and aerodynamic improvements over such gliders of the prior art.

Description of Prior Art

Manually launched toy airplanes in the simplest design Usually take the form of hand thrown gliders. The action of throwing a glider correctly requires significant coordination. Throwing a glider can be very difficult for many people and can be especially troublesome for young children. This challenging learning curve causes play to quickly become stale and unexciting. On the other hand, a toy glider that can be flown by hand or launched in an unconventional way like from a strike of the foot or an inanimate object such as a club or mallet, will provide new forms of athletic enjoyment and play for children and adults alike. To kick a glider into flight would be much easier and require less coordination and since the leg is usually much stronger than the arm, enables even a small child to kick launch glider for long distances. In the past, various U.S. patents have issued relating to various types of glider toys and aerodynamic toys. These glider toys usually take on the the configuration of an airplane. It has been found that in general, the airplane-like replica body shape configuration does not produce the best results when using the strike launch method from a ground level position.

Many toy gliders are uniquely constructed and designed with certain adaptations suitable for how it is be launched or to aid in its performance. For example, U.S. Pat. No. 9,227,677 issued to Mark J. Barthold set forth a toy glider with a hook member and spaced apart protrusions to accommodate attachment of an elongated rubber band. The glider is launched in a sling-shot fashion.

U.S. Pat. No. 3,187,460 issued to James H. Robertson set forth a glider with flexible wing in which a portion of the glider wing is flexible or pivotally movable to alter the flight path of the glider.

U.S. Pat. No. 5,176,559 issued to Stephen Lane set forth a glider formed of closed cell resin material having wings that behave like that of a bird. When the glider is thrown into flight, a recyclical up and down flapping movement of the wings will commence.

U.S. Pat. No. 5,019,007 issued to Jack V. Miller set forth a toy glider with variable dihedral wings. Wings are capable of movement from a horizontal direction to a vertical direction. Manually movable inboard and outboard wing sections permit wings to be reconfigured.

U.S. Pat. No. 4,411,249 issued to Bonnie R. Fogarty set forth a toy glider with pneumatic launcher. The glider is basically a set of wings on a flight tube which is moveably positionable on a launching tube of a pneumatic launcher. Compressed air is used to launch glider into flight.

Each of the aforementioned examples illustrate gliders constructed in a certain way with unique modifications particular to how it is to be launched and perform aerodynamically.

SUMMARY OF THE PRESENT INVENTION

Over the years, there have been no known patentable improvements to what may be called the kick-glider genre. Its rudimentary beginnings should only be thought of as the foundational base by which a more perfected conceptualization of the genre would thereby evolve. There exists a need to have a toy glider of the kick-glider genre distinctively constructed that set forth a high level of performance when thrusted from the ground into flight, with flawless operational ease, exceptional durability, and superb aesthetics. There is a continuing demand for simple and easily operatable toy gliders in general, but in ground launch strike flight gliders in particular.

The current invention presents a gliding toy offering many improvements over prior art gliding devices and set forth refinements in use and operation never before attainable. The invention provides improvements in manually launched toy gliders in general, but more particularly, the present invention relates to those toy gliders of the kick glider genre. Even more particular these improvements primarily apply to a fuselage or main body structure with inherent augmented lifting-qualities actuated with a strike to the rear of the glider to thrust launch airborne as opposed to being flung from the foot.

A glider toy that has a main body structure that extends between a nose and tail portion having a uniform thickness of the body between the forward and rearward edges represents a preferred structure, a tapering of the thickness between the forward and rearward edges may be adopted, if desired. Also, a specialize force receiving surface at the aft end integrally formed at a time of manufacture or independently constructed rearwardly confined surface to surface connection to be releasably interchangeable and sufficient to endure continuous and forceful strikes by foot or inanimate object such as a club or mallet.

A glider toy not only with Synchronous transitional movement between the surface-to-surface connection of the glider toy and the rearwardly disposed impact element but is operable for translational movement relative to that of the glider actuated by a maneuverable impact surface device. Despite the forementioned impactful elements, the glider toy main body structure can easily transition to an amphibious water toy to transverse across a body of water or as a simulated kickboard device to aid in swimming.

Toy gliders with the typical long and slender vertical body structure is found not to be the ideal configuration for optimum strike launch operation. This design is not practical for effective strike flight propulsion for several reasons, its vertical configuration and extremely narrow width would be problematic in placing a precise blow to the back of the glider to get it to strike launch properly. More than not, the glider will not maintain a proper orientation when struck but will likely flip or drag across the ground and if airborne, will veer hard right or left before crashing thus, making this configuration substantially objectionable for this method of launch. Therefore, a glider flown in an unconventional way, adaptable for use in air and water, requires an unconventional glider design. A glider fuselage made from relatively flat foam board material symmetrical about a longitudinal center line with broad lateral aerodynamic stabilizing surfaces to facilitate the lifting action of elective components like wing and tail members. There is a need for a ground launch glider constructed of shock absorbent material with a streamline fuselage or main body structure configured to promptly aid in lifting the glider airborne that will provide predictable flight performance. Gliders that mimic the form of actual airplanes work well for gliders launched in the usual hand thrown way for example.

However, for a glider to be launched into flight by a user provide impact force such as a strike by foot or by an inanimate object such as a club or mallet to self-levitate from a ground level position requires a particularly novel configuration to achieve the most dramatic results.

A new and improved main body structure of the kick-glider genre has been provided that flies vastly superior when impelled into flight from a ground level position than any of the known previous prior art. A glider toy that mimics the design of aquatic water boards, such as the aquatic design of the common kickboard, so substantially that it has all the aquatic qualities necessary to replicate a meticulous mimicry of a kickboard or water traversable toy. To amphibiously transition from a glider toy to a water toy is as simple as providing it with detachable wings and/or to flip the top surface of the glider toy over, the vertical tail component can now serve as a nautical fin to steer the glider amphibiously through the water.

To strike launch a glider toy with structural modifications similar to that of an aquatic water board with its generally delta shape structure, presents a high degree of reliable strike launch performance with its low center of gravity and relatively flat surfaces will exhibit unequaled stability in flight as well as maintain its beneficial aquatic qualities. This improved strike flight glider invention, provides an amphibious gliding toy or device that can transition for use in or out of water impelled in a first direction by a throwing, pushing, striking, or swimming motion. The glider can not only transform amphibiously with detachable appendages, but also transition to a kickable high-speed wingless projectile as well. The main body structure has been meticulously shaped not only to soar in the wind at substantial heights, but also for ground to air high-speed ballistic style strike launch projection. The delta shaped airfoil configuration provides positive lift and structural integrity when ballistically struck into flight like a rocket without any or minimally attached aerodynamic appendages.

The current invention adapts the buoyancy and stability of the hydrodynamic design of aquatic water boards, such as kickboards and the like, to that of the aerodynamic characteristics of a ground launched strike-initiated glider toy. Just as the common kickboard has broad and substantially flat top and bottom surfaces to aid in its buoyancy and stability as it moves through the fluid element of water unsupported by appendages, a strike flight glider toy constructed in a similar fashion as an aquatic kickboard provide similar results as it moves through the fluidity of air.

A glider toy with a kickboard configuration, in addition to the natural buoyancy of foam, is so well suited for unassisted aerodynamic use, that without facilitating components like wing and tail members, it could incidentally lift into flight, glide in air unappendaged as an unbridled airfoil capable of sustain flight over diverse distances when struck from the ground in a football-like fashion. The relatively planar back-end surface of the main body structure serves as a shock absorption wall of high impact resiliency and the zone of contact for the strike by foot or implement to impel the glider toy into flight. This rearward impactful surface at the tail end perimeter of the main body structure is preferably integrally molded or separately attached having static or mobile attributes and maybe further shielded with a layer of protective skin or padding. The cushiony characteristics of this feature both insulate the glider from damage and empower the thrust of the strike.

It is a general object of the present invention to provide a glider toy fashioned in like manner to an aquatic kickboard with the inherent capacity to be manually launched aerodynamically from the ground with a strike and transition amphibiously to traverse on water. A glider toy with strike launch capacity, with substantially augmented features that overcomes the disadvantages and limitations associated with the known art. A ground launch strike glider with a main body so aerodynamically apt it's capable of unappendaged solo flight to smoothly transition to wingless air and water play actuated by a user provided thrusting force. Thus, the invention is tentatively referred to from hereon when suitable as a strike flight glider.

The primary object of the strike flight glider invention, therefore, is to provide new and improved appurtenances to the kick glider genre such as a reinforced impact surface critical to withstand prolong use and that offers consistently reliable flight performance initiated by a ground level strike as well as the conventional hand thrown means, and which can easily transition to a functional aquatic toy or vice versa.

Another object of the present invention is to provide a strike flight glider with a wide range of performance characteristics that is configured to be impelled appendagelessly into flight in a ballistic, ground to air, football like projectile manner without any supporting or minimum aerodynamic attachments.

Another object of the present invention is to provide a glider toy that is more aesthetically pleasing and attractive by way of unconventional aesthetics. For example, a graphically attractive fabric surface cover with a woven polypropylene layer below the cover as seen on aquatic kickboards. Said fabric surface cover further protects the main body from damage as well. Additionally, the glider may also be constructed to include raised and recessed surface texture to illustrate contemporary images. Said raised and recessed surface texture have the capacity to alter aerodynamic properties of the glider in flight.

Another object of the present invention is to construct a strike flight glider of novel design that adapts the desirable properties and characteristics of aquatic water boards which effectively employ the principle of translational velocity to steadfastly skim across water or glide through the air.

Another object of the present invention is to construct a strike flight glider with a foam core of ethylene vinyl acetate plastic foam in one particular application while in another application the core can be constructed of expanded polystyrene foam (Styrofoam) or even a hollow glider toy with its main body structure including its rearward impact surface sustained by confined air at or after a time of manufacture.

Still another object is to have a glider toy with selectively embedded fore and aft longitudinal counterweight elements to aid in equilibrium, stability, and enhanced main body strength. A counterweight that is preferably entrenched removably within the belly of the glider along the longitudinal center line.

Yet another object is to have a glider toy that employs an innovative impact-responsive protractible booster tail means to amplify the forward thrust after the initial strike. This protractible booster tail means is preferable not specific to any particular glider configuration but can be employed to many different aircraft body styles or even to different vehicle types such as a submarine body or rollable vehicles like toy trucks and cars.

Another object of this invention is to provide a method of constructing an amphibious strike flight glider toy having all of the aforementioned characteristics of both glider and water board. A glider which effectively employ the principle of translational velocity to attain lift and glide in air and water. Those skilled in the art will readily appreciate that various other types of materials and shapes can be employed within the scope of the present invention.

BRIEF DESCRIPTION OF THE DRAWING FIGURES

The drawings depict specific embodiments of a novel glider toy capable of ground launch capacity with a main body structured to behave like an airfoil incorporating aerodynamic and hydrodynamic amphibious characteristics. It is to be understood that such are not to unduly limit the scope of the invention. Other objects and advantages will be apparent in the following detailed description, taken in conjunction with the accompanying drawings, in which.

Figure 19:
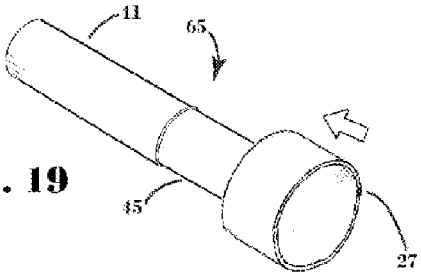

FIG. 19 a perspective view is of a detached protractible booster tail assembly unit.

Figure 20:
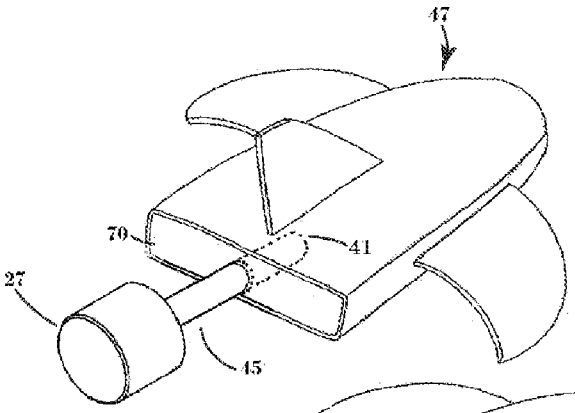

FIG. 20 is a perspective view of the glider toy which shows an attached fully extended protractible booster tail assembly unit.

Figure 21:
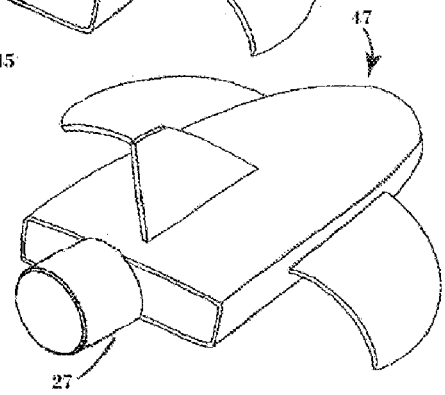

FIG. 21 is a perspective view of the glider toy which shows an attached fully retracted protractible booster tail assembly unit.

Figure 22:
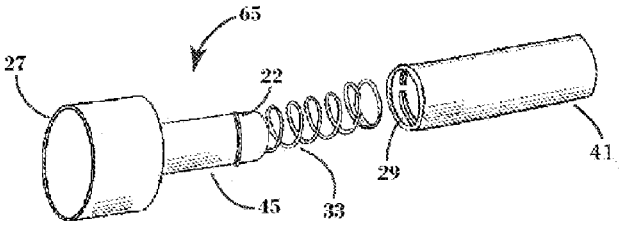

FIG. 22 shows an exploded perspective view of a booster tail assembly unit.

FIG. 23 is a side sectional view of glider toy showing the attached protractible tubing and inner coil spring apparatus in a thoroughly reposed position.

FIG. 24 is the side sectional view of FIG. 23 which shows the retracted tubing apparatus causing intense compression of the inner coil spring member.

FIG. 25 is a perspective view of another embodiment of FIG. 22 which shows a means to 'lock' the tubing members in a retracted position.

FIG. 26 is a perspective view of the embodiment of FIG. 25 illustrates the tubing members with affixed impact surface in a retracted and locked position.

Figure 27:
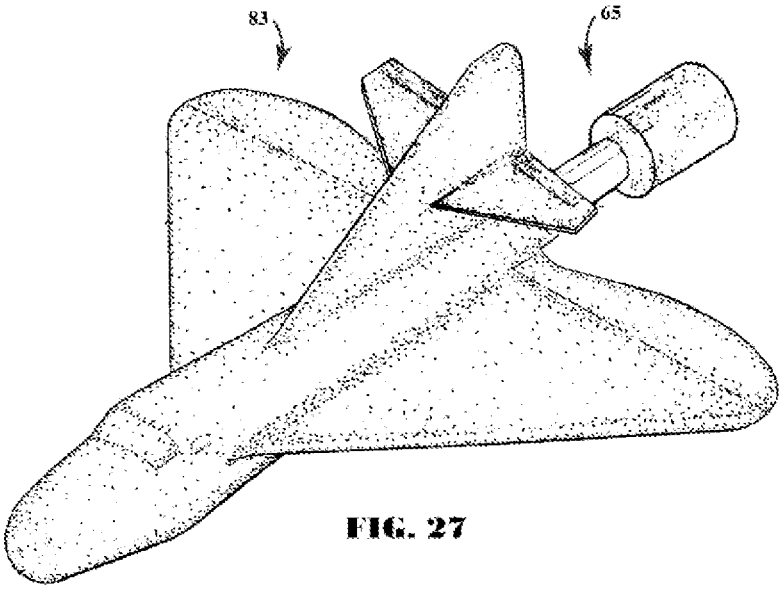

FIG. 27 is a perspective view of a common rectangular shaped glider toy with an attached protractible booster tail assembly unit.

Figure 28:
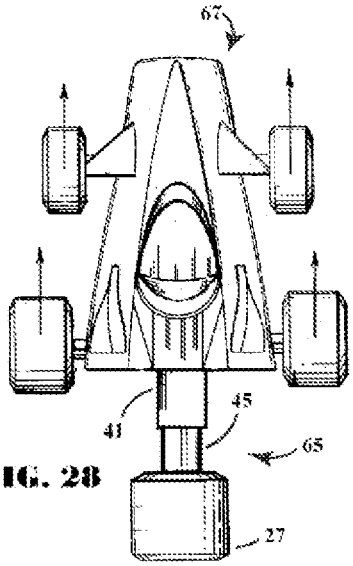

FIG. 28 is a top plan view of a rollable toy car with an attached protractible booster tail assembly unit.

Figure 29:
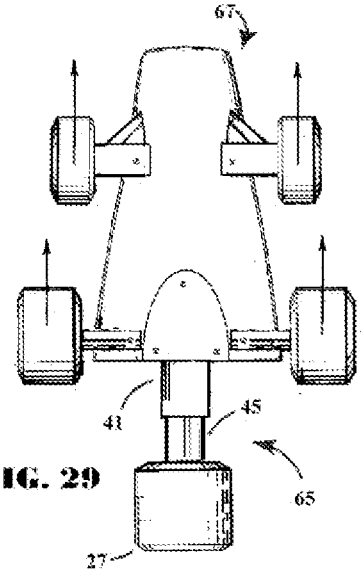

FIG. 29 is a plan view of the underside of the rollable toy car with attached protractible booster tail assembly unit.

Figure 30:
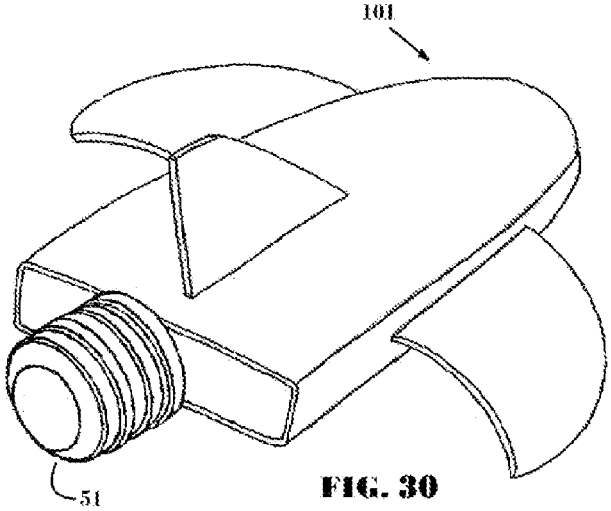

FIG. 30 is a perspective view of the glider toy with an attached bellows style protractible booster tail.

Figure 31:
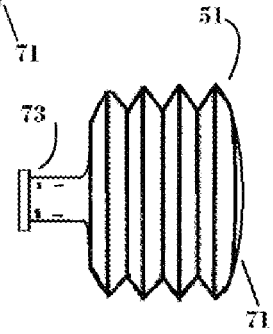

FIG. 31 is a side plan view of a detached bellows style protractible booster tail.

Figure 32:
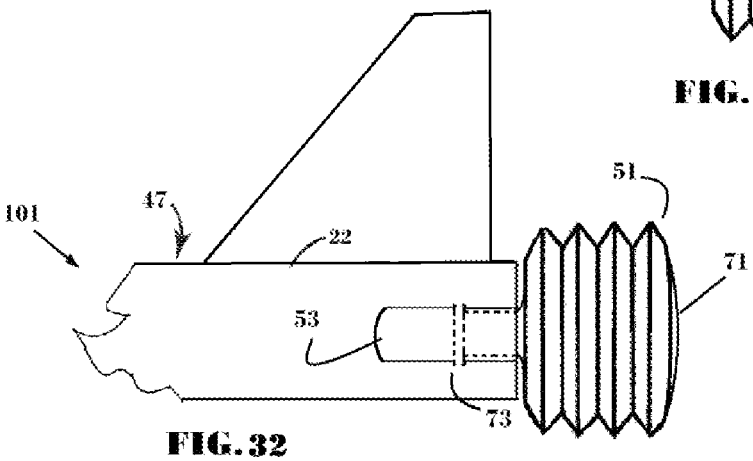

FIG. 32 is a is a side sectional view of glider toy illustrating the connection between the glider toy and bellows style impact surface.

Figure 33:
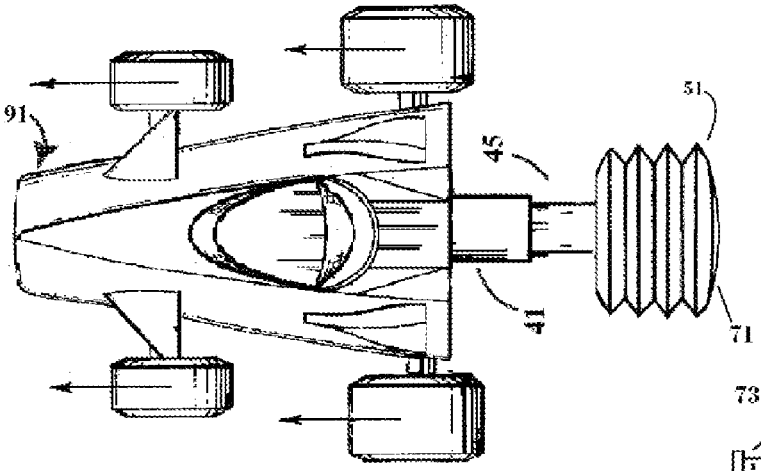

FIG. 33 is perspective view of a rollable toy car with an attached bellows style protractible booster tail.

Similar reference numerals refer to similar parts throughout the many views of the invention drawings.

DETAIL DESCRIPTION OF THE EMBODIMENTS

Figure 1:
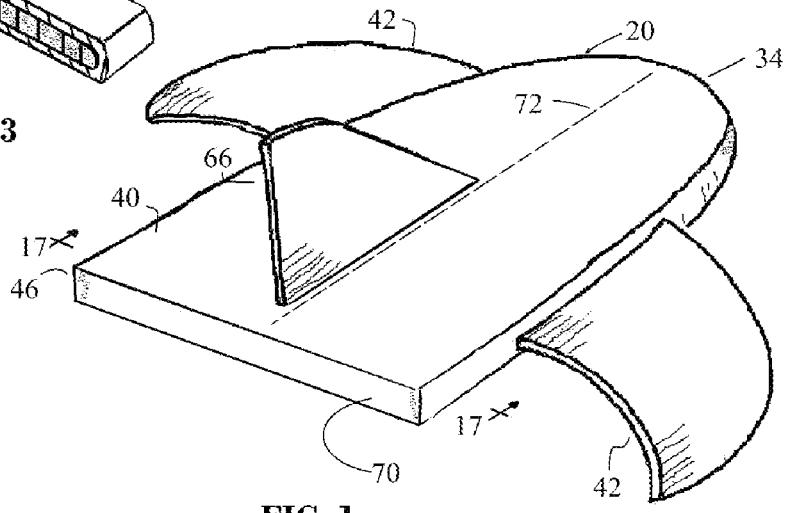
FIG. 1 is a perspective view of one embodiment of the glider toy which illustrates a laterally formed rearward strike surface.

With reference to the drawing shown in FIG. 1, which illustrate one embodiment of a strike flight glider toy made in accordance with the present invention having a main body structure 20 designed similarly to the common aquatic kickboard and other relatively flat, wadge and/or delta shape elongated water boards. The glider comprises a kickboard like elongated fuselage or main body structure 20 with relatively flat surfaces comprising of a top surface portion 40 and a bottom surface portion 48, at least one vertical stabilizer tail 66, a frontal nose portion 34, a relatively lateral and planar back-end portion 46, and a right- and left-wing member 42 made from a flat sheet material symmetrical about a longitudinal center line 72. The main body structure 20 preferably molded from a single solid piece of foam or similar material being relatively wide in width.

The functioning formation of the main body structure 20 relies on translational velocity to acquire lift similar to an airfoil, has inherent aerodynamic characteristics to act as a wing. The airfoil like effect caused by air currents on the relatively flat and wide surfaces of the main body structure 20 and aerodynamic surfaces enables the glider to promptly go airborne when struck from the rear at the back-end portion 46 into flight.

Figure 2:
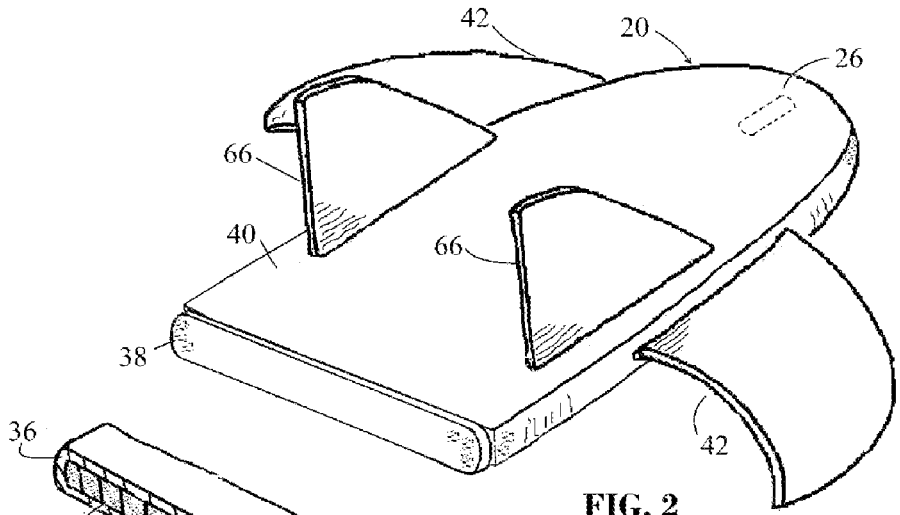
FIG. 2 is a perspective view of the glider toy shown with bilateral vertical tail components and rearwardly attached protective padding material.

FIG. 1 illustrate a single vertical stabilizer tail 66 centrally Placed along the longitudinal center line 72 of the main body structure. FIG. 2 illustrate glider toy in accordance with the present invention that has the vertical stabilizer tail member 66 paired on diametrically opposite sides of the top surface 40 just forward of a relatively planar thrust receiving impact surface 70 laterally disposed at the back-end portion 46 of the glider.

Figure 9:
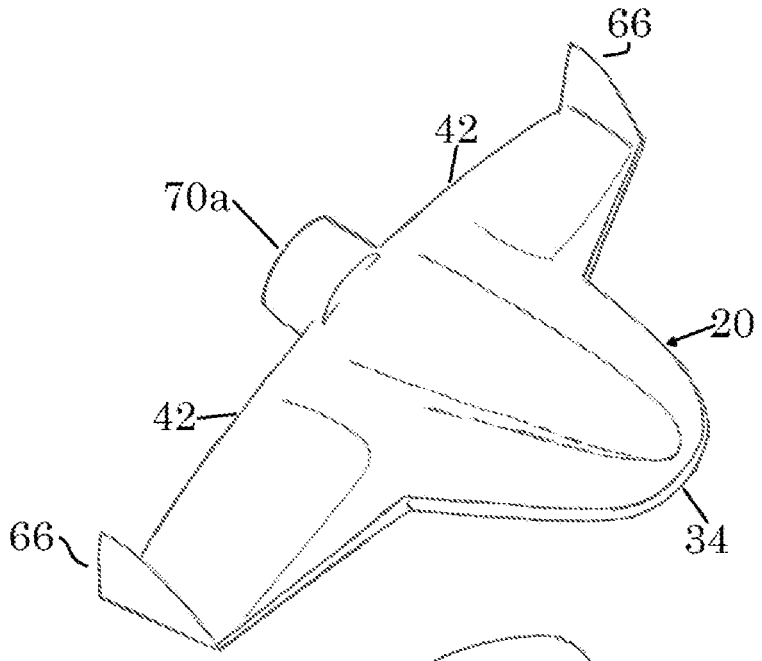
FIG. 9 is a perspective view of an alternate embodiment of the glider toy in which a vertical stabilizer tail member is disposed at each aft end of the right- and left-wing member.

Turning now to FIG. 9, an alternate embodiment of the glider toy whereby the vertical stabilizer tail 66 is a pair with one each attached to or formed from the extreme ends of the right- and left-wing member 42.

To have a glider toy thrusted into flight from a stationary ground position by a strike of the foot or an inanimate object such as a club or mallet requires it to be designed with unique structural characteristics particular to this genre of gliders in fact, the main body itself is augmented to have similar lifting characteristics as a wing. An essential component to a glider toy launched into flight by a strike, but not typical of other toy gliders, is a specialized empennage impact surface feature referred herewith as a booster tail 70. It is the most rearwardly extended planar surface at the back-end portion 46 of the fuselage or main body structure 20. The booster tail 70 serve as the focus point of impact.

Figure 4:
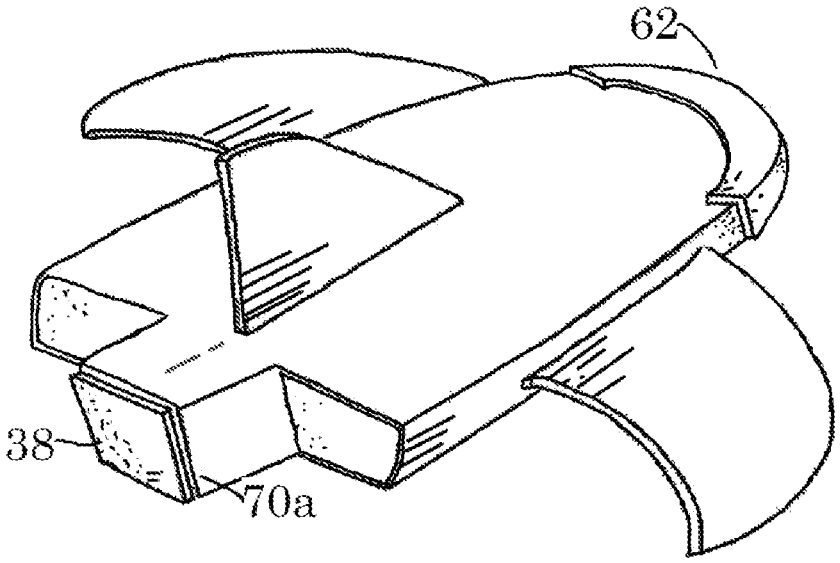
FIG. 4 is a perspective view of an embodiment of the glider toy which shows an integrally formed rearwardly protruding strike surface and a nose guard covered front portion.

The booster tail impact structure comes in three basic forms, an impactful rearward surface area integrally molded from the main body laterally disposed or an integrally molded rearward protrusion as seen in examples FIGS. 1 and 4.

Figure 7:
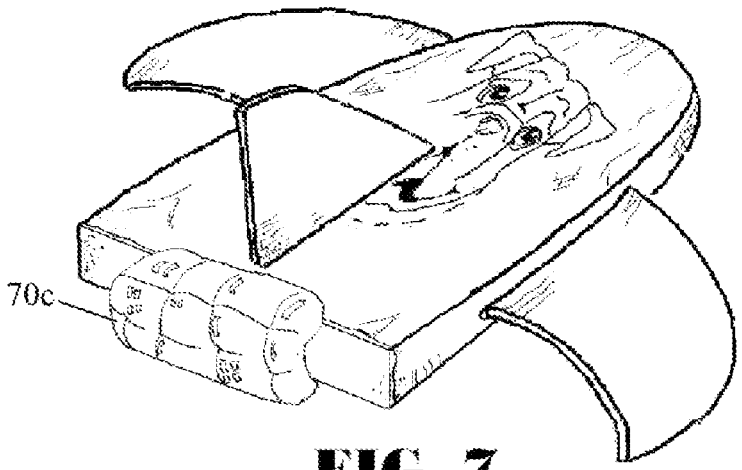
FIG. 7 is a perspective view of an embodiment of the glider toy draped in a protective fabric covering and an air infused strike surface.
Figure 6:
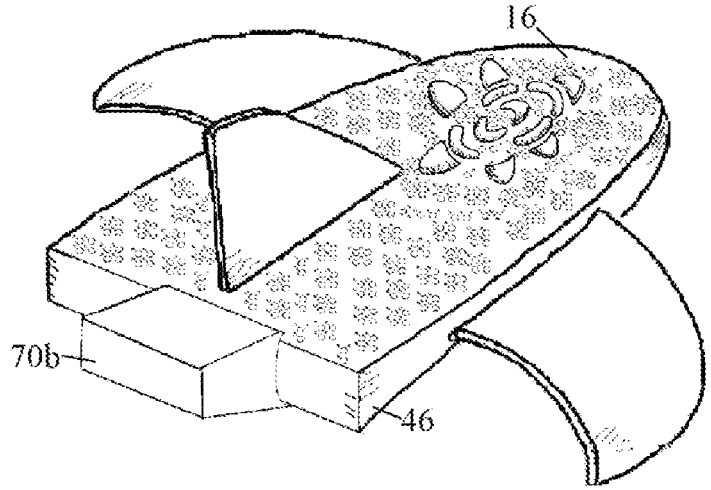
FIG. 6 is a perspective view of the glider toy which depicts raised and recessed surface texture and attached strike surface.
Figure 15:
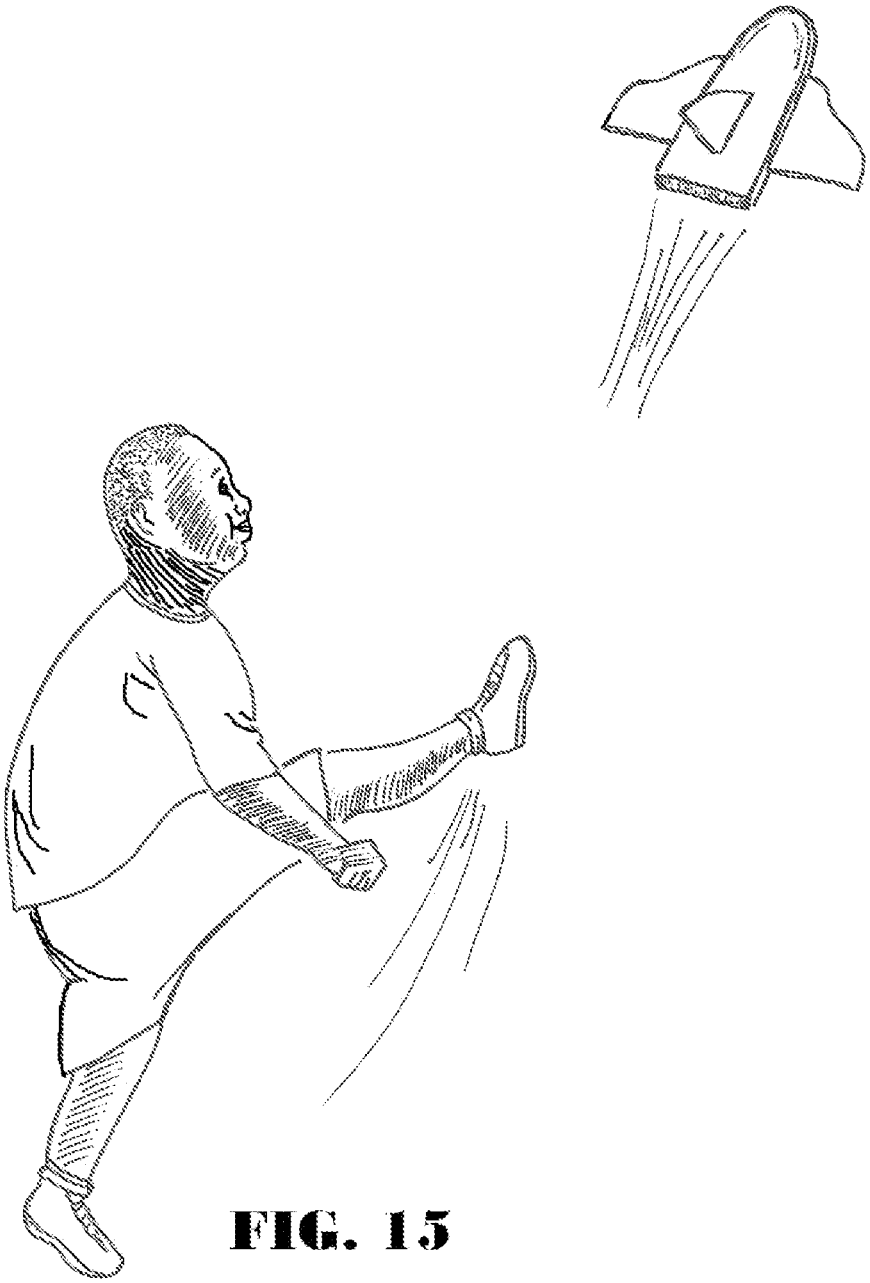
FIG. 15 is an environmental view of one embodiment of the present invention shown operatively associated with a user.

A releasably attached surface to surface rearwardly anchored strikable substance as in the examples of FIGS. 6 and 7, and thirdly a linearly maneuverable rearward impact surface as in the examples of FIGS. 20, 25, and 30. This highly perdurable rearward 'wall' is designed to receive the explosive thrust from a kick or strike by an inanimate object such as a club or mallet to propel the glider toy from the ground into flight as illustrated in the environmental view of FIG. 15 whereby a user has performed a kick launch of the glider toy is shown.

Figure 5:
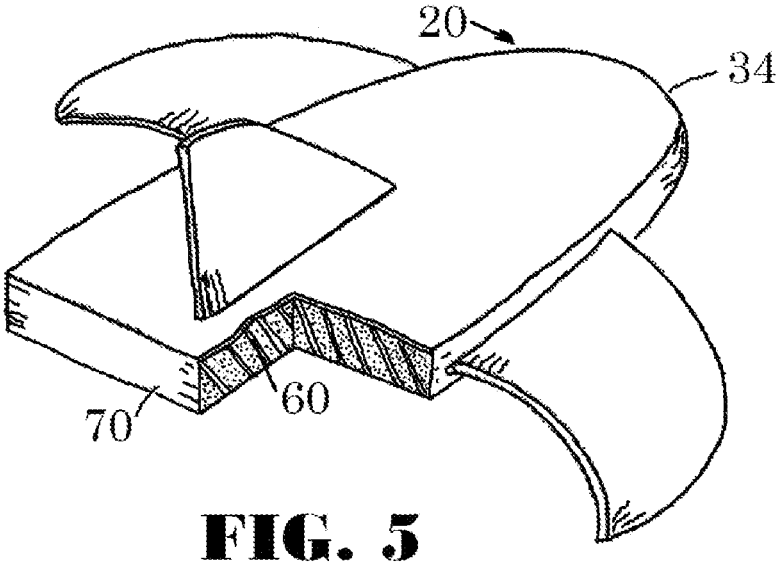
FIG. 5 is a partial cut away of the rear and side portion of the glider toy to expose its inner core.

Turning now to FIG. 5, the glider toy in accordance with the present invention may, for example, comprise a foam core 60 made of rigid or semi-rigid foam material such as polyethylene foam, polyvinyl chloride foam, ethylene vinyl acetate foam, polypropylene foam, or any combination thereof. By broadening and substantially flatling said foam core 60 to mimic the structure of a kickboard, with its natural precipitative responsiveness, results in inherent stability thereby the glider will overcome any tendency to displace or turn from normal flight. In general, and in one form, the booster tail 70 is a relatively lateral surface rearwardly disposed at the back-end portion 46 of the main body structure 20 that's within the impact zone of the biasing means and thereby receives the full force of the biasing strike.

Figure 14:
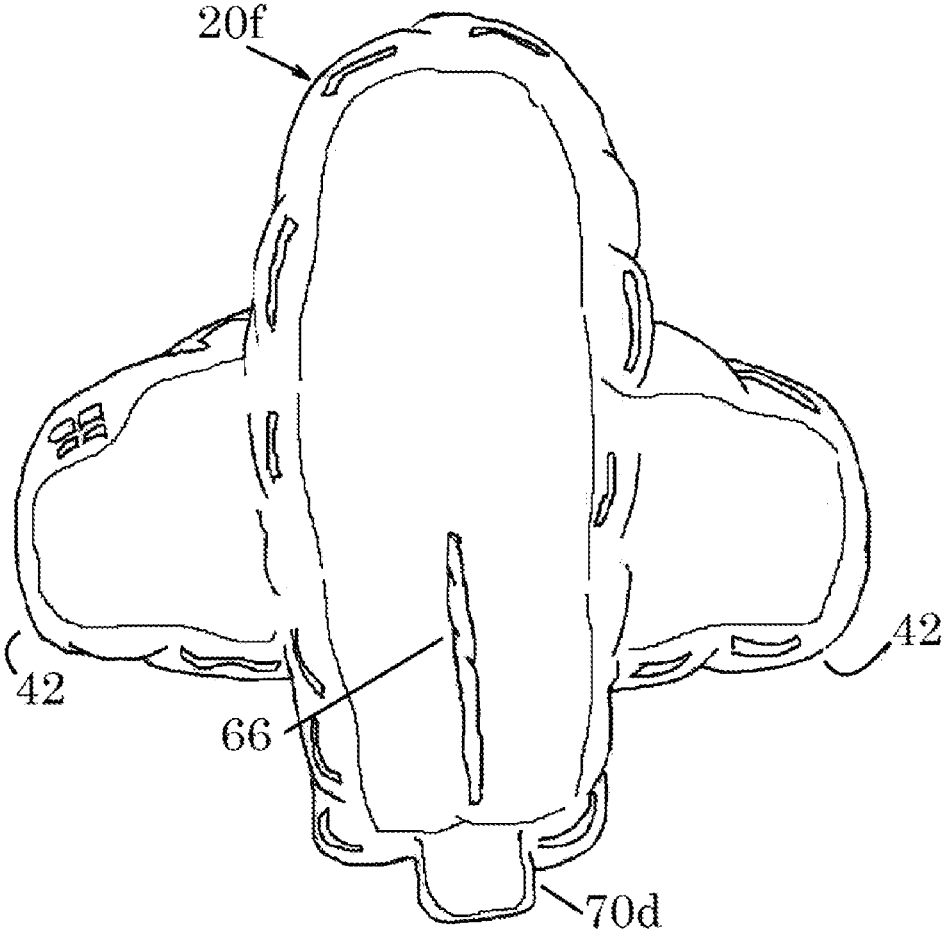
FIG. 14 is a top plan view of an alternate embodiment of the glider toy with a main body core sustained by a disbursement of confined air.

The booster tail in general can simply be a resilient impactful rear surface of the fuselage itself as shown in FIGS. 1, 2, 8, and 16, an impactful extension of the fuselage that protrudes out from the rear as shown in FIGS. 4, 9, and 14, or an impactful surface to surface attachment secured to the rear of the fuselage as shown in FIGS. 6, 7, 20, 30 for example. The booster tail preferably provides a resilient, reboundable, and impactful strike structure.

The booster tail member can still be further enhanced for striking by adding an overlay of protective padding 38 of elastomeric material to the strike surface to shield surface 70 from damage as illustrated in FIG. 2 and FIG. 4. Ideally, it's preferable to place the impactful actuating force along the center rear of the main body structure 20 at about the longitudinal center line 72 to achieve consistent flight performance. However, to make impactful use of substantially the entire length of a lateral impact surface as shown in FIG. 1 gives one more options to direct the strike at different angles. To strike at different angles will vary the flight trajectory of the glider. To somatically adjust the flight path by point of physical contact with a strike will thereby introduce an element of skill in the operation of the toy. This would be a desirable option for those that demonstrate an advanced ability.

The booster tail depicted in one embodiment as being relatively planar in shape. This should not however limit its shape to such since non-planar shapes would work just as well. Rectangular, cylindrical, or even square, could also be considered as possible configurations to name just a few. The preferred requirement is that it be relatively light in weight with a very resilient quality.

Figure 8:
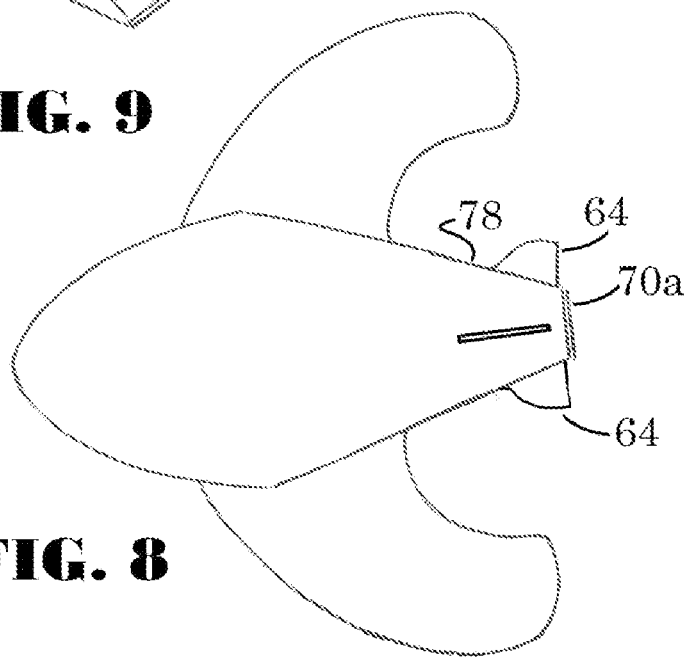
FIG. 8 is an embodiment of the glider toy which illustrate a top plan view whereby the main body structure has a succinctly tapered trailing end culminating in vertical and horizontal tail members.

The embodiments of FIG. 4 and FIG. 9 depicts the impact surface as an intrinsically disposed protuberant 70*a* extended narrowly from the main body structure to offer effective guidance in a centrally placed strike. A similar result is illustrated in the embodiment as shown in FIG. 8 whereby the main body structure has a succinctly tapered trailing end 78 which also results in a centrally confined rearward booster tail 70*a*. To substantially narrow down the strike zone to a specific spot will make a ground launch much less troublesome for a very young or unskilled child.

A glider toy with strike launch capacity constructed of a semi-soft foam material like that of polyurethane or similar, would preferably have the booster tail component integrally molded conjunctly with the main body structure as a single piece as illustrated in FIGS. 1, 4, 8, and 9 examples. This type of foam and those with similar resiliency should hold up quite well under normal use. However, A very common and widely used alternative to a form plastic material for toy gliders is expanded polystyrene which is also commonly known as Styrofoam. While this type of foam from a manufacture's point of view satisfies desirable criteria such as easy to make, reasonably sturdy, light weight, and inexpensive nature make it ideal for toy gliders. Styrofoam has its disadvantages when used repeatedly as the object of a strike, mainly because of its fracturable nature. Nevertheless, several clever solutions can effectively remedy this problem to allow its use as a kick and/or strike launch glider.

Styrofoam can of course be manufactured in various degrees of density and thereby the main body structure 20 of the glider toy can be made quite sturdy, still yet its rigid and brittle nature is not conducive to continuous strikes. An effective solution to take advantage of the many desirable qualities of Styrofoam is illustrated by FIG. 6 in which an attachable booster tail component 70*b* made of a virtual solid block of sturdy, resilient material centrally secured to the back-end portion 46 of the glider toy.

Figure 3:
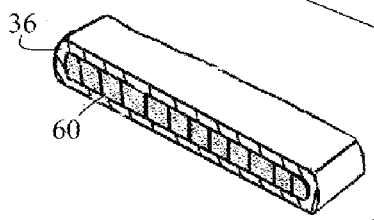
FIG. 3 is a fragmentary view of a cross sectional cut away of the inner core material and its protective resilient outer shell.

Another solution is to have a thick, yet pliable protective padding 38 material readily attached to cover the entire impact receiving surface area as previously mentioned as shown in FIGS. 2 and 4. Still another option is to encase the entire flaccid and brittle foam core of the main body structure 20 in an impervious resilient shell 36 such as a pliable foam rubble, plastic, or the like as shown in the sectional cut away of FIG. 3 example. The shell encasement will not only protect the core of the glider toy but serve to waterproof the glider toy when used as a water toy.

FIG. 7 illustrate a more profound approach for enabling the use of Styrofoam by presenting the solution of an air-infused booster tail 70*c* gaffed at the time of manufacture similar to the bloated lining of a football or basketball. But just as well, a more sophisticated structure can be employed which incorporates an advanced high-impact design with a core of individual air-filled cells. This advanced structure of impact-absorbing thermoplastic elastomers combines the best properties of rubber and plastic for superior durability and performance in both dynamic and static applications could be extensively used in this invention. Each of the aforementioned solutions, whether used separately or in combination, will effectively soften the blow of the strike and thus, prevent damage to a strike flight glider and other designs made principally of Styrofoam or other frangible material.

The exterior of the fuselage and other parts of toy gliders made principally of foam are typically decorated by the common means of stick-on decals or screen-printing techniques for eye-catching decorative graphics. FIG. 6 illustrate an improved means of aesthetic enhancements of a glider toy employing raised and recessed surface texture 16 integrally formed to create a three-dimensional pattern or attractive image. The three-dimensional pattern provide a new and improved means to make the toy gliders more aesthetically pleasing and attractive to the would-be buyer. Raised and recessed surface texture 16 is not only a potent stimulus to the sense of sight but of touch as well.

In addition to aesthetics, raised and recessed surface texture 16 is capable of altering the aerodynamic properties of the glider toy in flight with a direct and profound effect on lift and drag similar to how the textured surface of a golf ball or Frisbee disc can prolong its flight time.

The alternate embodiment of the glider toy shown in FIG. 14. has a substantially unique structure. This particular embodiment excludes a solid core of any kind. The fuselage is constructed from a thin flexible yet durable material such as plastic, latex, or polyester film. The main body structure 20*f* has the same general planar features and lifting characteristics as the previous embodiments including wing member 42, vertical stabilizer tail 66, and a thrust receiving impact surface 70*d* etc., however, the glider toy of FIG. 14. has an entirely hollow body structure sustained by confined air at or after the time of manufacture. A hollow main body consisting of confined air will create a powerful forward thrust when the glider is impacted into flight by a user provided launch force strike of the foot.

Turning now to the embodiment of FIG. 9, which features an entire Strike flight glider molded from a single piece of pliable material including wing member 42, vertical tail stabilizer 66, and booster tail 70*a*. There are many advantages to having the entire glider with all its parts integrally molded as one structure. This will decrease manufacturing time, lower the cost, and prevent dislodgement of the wing and tail components when a crash or sudden forward stop occurs to prevent the possibility of missing or lost parts.

Figure 12:
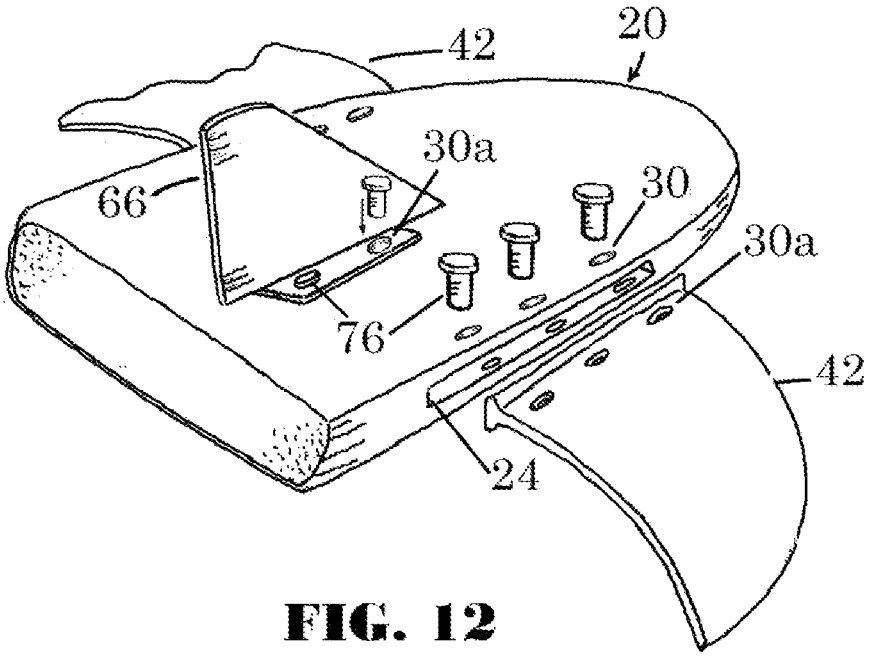

With most toy gliders, (especially with the larger gliders), it's common to have the wing and tail members placed in a slot 24 cut into the fuselage as shown in FIG. 12. The wing 42 and tail members 66 are mountable in place by non-permanent frictional means within the slot. The wings and other parts being removable is very advantageous in transportation and replacement of damaged components.

Figure 13:
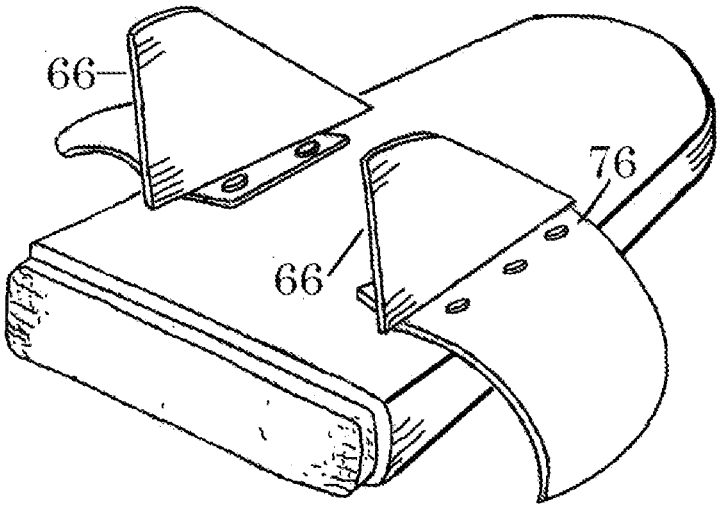
FIGS. 12 & 13 is a perspective view of the glider toy illustrating a means of mounting the wings and vertical stabilizer tail to the fuselage.

The disadvantage of fictionally attachable wings and tail components is dislodgement of these components when a crash or sudden forward stop occurs. Constant inserting of dislodged components will become unnecessarily burdensome. FIGS. 12 and 13 provide a means for readily mounting and dismounting of the left- and right-wing member 42 and vertical stabilizer tail member 66 within a slot 24 yet also provide a means to keep members secured to the glider toy when in flight or when a crash or sudden forward stop occurs. Demountable aerodynamic appendages makes for quick transition for amphibious use as well.

The relatively planar kickboard configuration of the main body structure 20 makes it aptly suitable for the use of connecting pins or dowels 76 for keeping the wings and vertical tail members in place. The right- and left-wing member 42 are placed in wing slots 24 on top or side of the main body structure 20. The dowels 76 enter prepositions holes 30 in the main body structure 20 and holes 30*a* in the wings and vertical stabilizer tail members 30*a*. The holes of the fuselage and wings are aligned and are spaced and sized to secure a supply of dowels 76. The members are fictionally pined to main body structure 20 and fastened in place. Detachable fastening of the glider toy right- and left-wing member 42 and vertical stabilizer tail member 66 to the main body structure 20 with dowels 76 effectively prevents displacement of said members when the glider toy is launched, involved in a crash, or sudden stop occurs. To have a means to securely attach and remove appendages will effortlessly convert the strike flight glider toy to a wingless projectile or an object of aquatic means such as a swimmer's kickboard.

Figure 11:
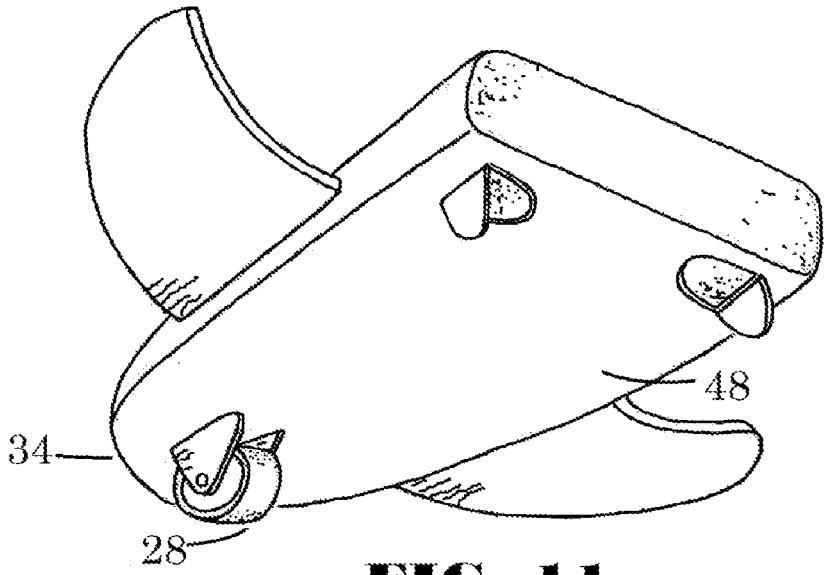
FIG. 11 is a perspective view of the under surface of the glider toy which depicts several lifting elements with one in the form of a rollable wheel.
Figure 10:
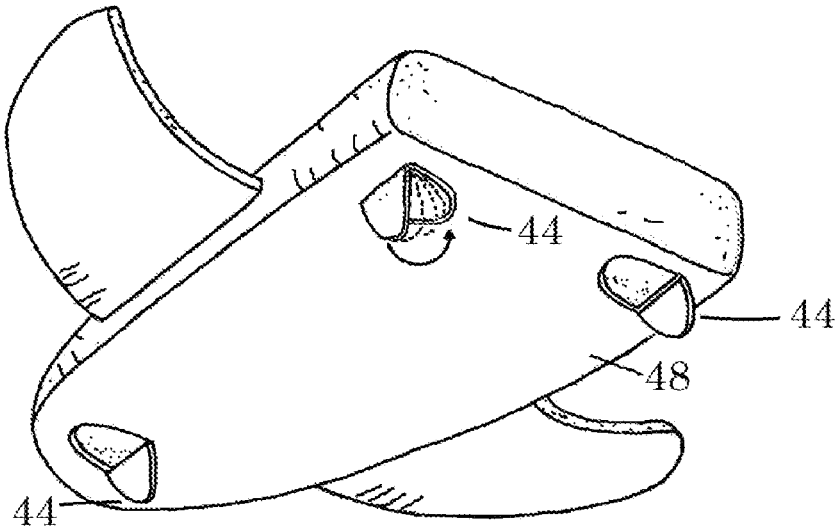
FIG. 10 is a perspective view of the under surface of the glider toy which depicts several retractable lifting elements.

Referring to FIG. 10, depicts a lifting means of retractable Stanchions 44 that is hinged to and protrude from the underside of the bottom surface 48 of the glider. The purpose of said lifting means is to elevate the bottom surface so to lessen contact with the ground and reduce drag and wear of abrading surfaces on the glider. Launching the glider toy from a smooth, hard surface supported by the stanchions 44 is the preferred flight method. FIG. 11 feature both a lifting and a rollable means in the form of a wheel 28 underneath the nose portion 34 of the strike flight glider. To strike launch the glider toy on a smooth flat surface will cause it to taxi or roll slightly along the ground mimicking an actual airplane before lifting into flight. However, by retracting the stanchions 44 that protrude from the bottom surface 48 of the glider and resting the strike flight glider toy on its protected 'belly', will facilitate unobstructed forward movement to successfully strike launch the strike flight glider from grassy, sandy, or gravel like surfaces common at most parks or beach areas.

A common but important element applied to most free flying gliders is to have a ballast of some kind to control the position of the center of gravity. A ballast 26 placed on or within the nose portion 34 of the strike flight glider as seen in FIG. 2, will effectively move the center of gravity forward to give balance and stable flight performance. The ballast 26 element can be constructed from a rigid material such as rubber, metal, or a synthetic resilient plastic material. It has been found that the degree of dissimilarity between the weight of the ballast in conjunction with the total weight of the glider is an important characteristic in determining whether a glider will perform with the desired optimum vivacity.

Toy gliders for obvious reasons are typically constructed of extremely lightweight materials. Air flow causes lift but air and wind can also be problematic for a lightweight, imbalanced glider due to drag and wind resistance. The common hand toss gliders for example are generally impractical in a strike launch operation being ineffectually designed for the purpose because; they are commonly made of fragile components, tend to be very light in weight, does not possess the necessary inertia to be forcefully impacted into flight from the ground with a strike.

Typically, manually launched toy gliders are held steadily and firmly in place by hand or with some apparatus at a crucial moment just before launch to ensure unswerving stability as it moves forward into flight. The transition into flight from a strike launch operation has the strike flight glider toy unrestrained at the time of impact. This may require an additional stabilizing feature to achieve a persistent stabilize launch to prevent any divergence from a straightaway non faltering flight especially in moderately high winds. Likewise, distinct from the previously mentioned embodiments, the embodiment of FIG. 8 not only has a vertical stabilizer tail member 66 but also employ a horizontal tail member 64 as well adjacent to the impact surface at the aft end of the glider toy. The horizontal tail 64 provides added stability to the relatively elongated, tapered back-end portion of the strike flight glider of FIG. 8.

Figure 17:
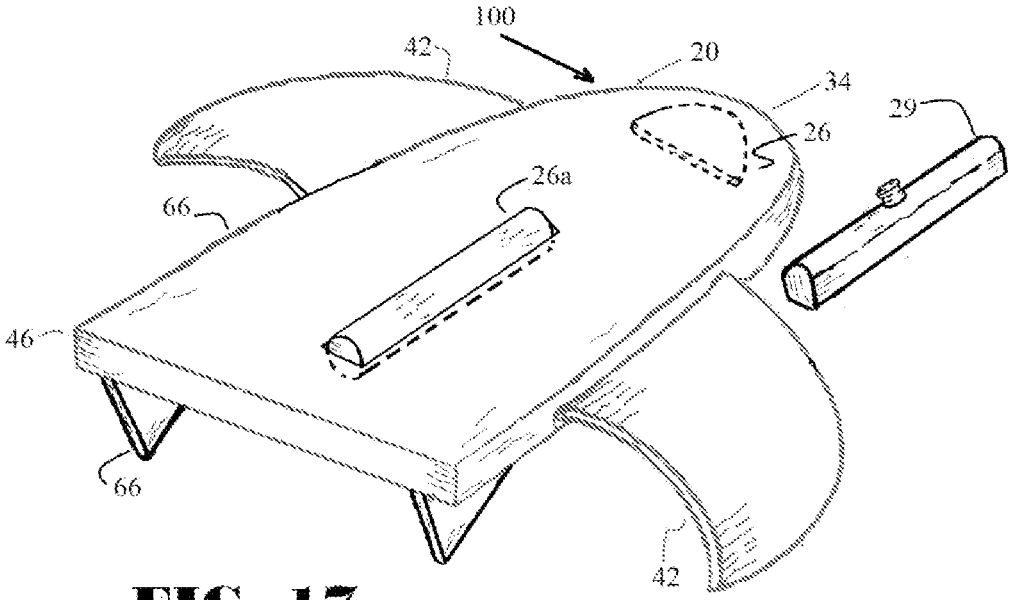
FIG. 17 is a perspective plan view of an alternate embodiment of the glider toy with intrenched counterweight elements and belly plug.
Figure 16:
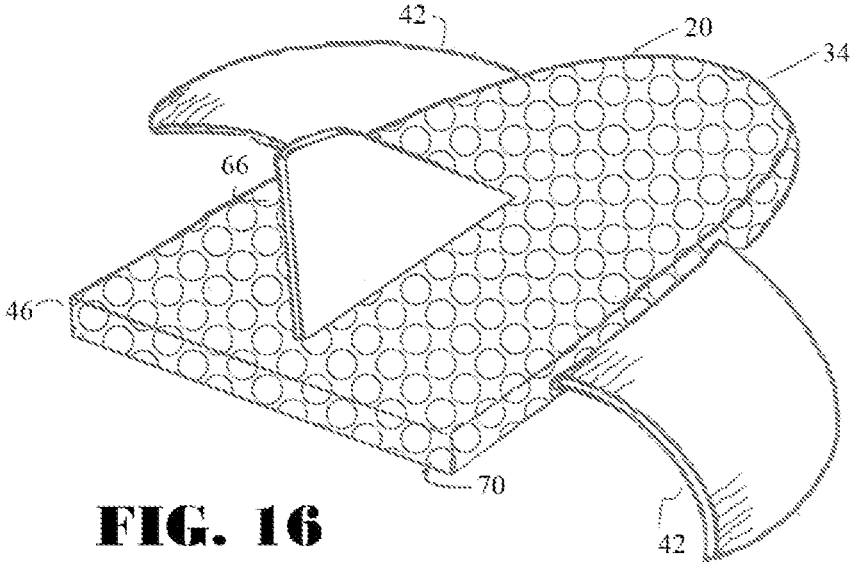
FIG. 16 is a perspective plan view of an alternate embodiment of the glider toy having a recessed surface texture.
Figure 18:
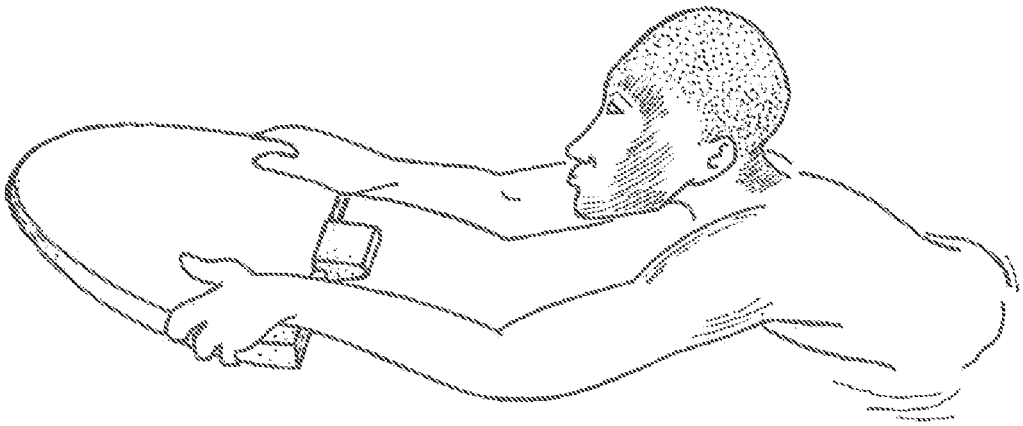
FIG. 18 is an environmental view of an amphibiously operatable glider shown in association with a user constructed in accordance with the teachings of the present invention.

To provide a lightweight ground launch glider toy with the inertia needed to deal with wind resistance by increasing its weight when appropriate, to a greater degree would be the plausible solution when you consider the scenario of FIG. 17 which feature a strike glider toy 100 possessing one or more selectively embedded counterweight elements 26*a* allied in conjunction with the forward nose portion weight 26. The option to have a removably entrenched counterweight element 26*a* to use when needed will increase the weight and stability along the mid and rear portion of the strike flight glider 100 and channel the thrust of the strike to the weighted nose portion 26. This balance of front, middle, and back equilibrium will give the glider toy the drive and backbone to overcome resistance and push through the launch without any substantial tottering due to wind or ground resistance that could cause a disruptive, floundering effect upon launch.

The embedded counterweight element 26*a* primarily takes the shape of an elongated cylinder or bar removably entrenched steadfastly within the underside or belly of the main body 20 and is therefore descriptively referred to as a belly bar. This counterweight bar element substantially covers the length of the glider toy preferrable along its longitudinal center line 72.

The belly bar holding trench is capped with a suitable sized plug 29 to reseal the open trench of the belly bar. While the belly bar 26*a* is preferrable a solid elongated structure, smaller fragmental pieces can be used to replicate a longitudinal lay out or be dispersed indiscriminately about. The placement, weight, strength, and elongated length of the belly bar 26*a* counterweight element serves several essential functions.

The substantially elongated length of the belly bar 26*a* centrally aligned along the longitudinal axis of the main body makes an effective conduit in transferring forward the intensity of a user provided strike. Just as a lightning rod channels the power of the lightning strike in a specific direction. The rigid strength of the belly bar 26*a* encased within a relatively flaccid main body will enhance the weight and strength of the main body 20 without adding substantially more to its overall mass. The stiffening of the fuselage or main body structure 20 with the entrenched belly bar element 26*a* that extend laterally through the body enables the strike flight glider 100 to be launched with more force than could otherwise be applied to a lightweight foam glider. This centrally added mass empowers the substantially lightweight glider toy to resist the commonly awkward in air recoil occurrence of light-weight gliders when forcibly impacted into flight. The belly bar assures overall equilibrium between weight, thrust, drag, and lift for consistently maintained proper orientation both in air and water.

Turning now to FIG. 4, with reference to the drawing, a strike flight glider made in accordance with the invention comprises a nose guard 62 component affixed at the lead edge of the glider toy. The nose guard 62 formed of a rubbery or resilient plastic material with a thickness consistent with the strength and weight desired. The nose guard 62 has a multipurpose function, to resist deformation of the glider upon impact with another object as well as assist as a ballast. In addition, this component can also serve as a protective skid underneath the nose portion 34 for launching and landing of the strike flight glider toy. Still even more, the nose guard has a first weight and is interchangeable with extra nose guards having different weights than the first weight to alter a center of gravity of the main body and thus augment its performance.

Ordinarily the booster tail component is a singular inert propulsory strike surface or resilient substance anchored to or molded from the rear of the glider toy. Its most notable characteristics being its protectiveness and reboundable resiliency after the strike. Turning now to FIGS. 20 thru 28 that presents an alternate embodiment of an impact surface as a member of a collapsible, and protractible, multi-part booster tail assembly unit 65. It has similar characteristics of resiliency as a stationary impact surface like the booster tails shown in FIGS. 1, 4, and 6, but with added apparatus means to augment the boost after the initial strike by the user provided launch force. In this innovative launch means apparatus, the strike surface element is capable of independent forward progression when struck in advance of any reciprocation by glider toy.

The booster tail element is part of a unit that enables it to transition from stationary to linear movement relative to that of the fuselage to make an impactful surface to surface contact with the rear of the fuselage to initiate the launch of the glider toy. The protractible booster tail assembly unit 65 is a conglomerate of components designed to amplify the forward thrust of the strike flight glider 47 after the initial strike launch. FIG. 19 illustrate the parts of the protractible booster tail disassembled and detached from glider 47. The primary parts consist of a pair of tubular members 41 and 45, a coil spring 33 component, and a booster tail like bumper member 27 which functions as the strike surface. An outer tubular member 41 in the form of an outer sleeve, an inner tubular member 45 in the form of a hollow sleeve with an outer diameter sized to be received within an inner diameter of the outer tubular member 41. The coil expansion spring 33 is oriented within the outer tubular member 41 and the inner tubular member 45 and engages the closed end cavity of the hollow tubing members to provide expansion of the protractible booster tail assembly 65 by biasing the outer and inner tubular members 41, 45 away from each other.

The embodiment of the booster tail component that's attached to the leading end of the inner tubular member 45 that juts out from the outer tubular member 41 has a resilient impact responsive surface. This strike engaging surface or booster bumper 27 component movement is initiated by a user provided impact force relative to the propulsory strike to boost the glider toy into flight. The booster bumper 27 is similar in structure and characteristics to a stationary booster tail. The booster bumper 27 moves in relation to the tubular members 41 and 45 as it contracts and extends along a linear projection in response to the user-initiated impact. The booster bumper disposed at the fully extended tubing members is the first or start position wherein the unit is operable under a user provide biasing force.

An annular formation of raised ridges 22 on the outer surface of the inner tubular member 45 near its approximate end and a corresponding set of raised ridges 29 on the inner surface of the outer tubular member 41 near its approximate end works in cooperation to prevent a decoupling of the linked tubing members. By forcing the ridgemented tubing members approximal ends beyond opposite sides of each other would effectively secure their attachment to minimize inadvertent disassembling of the unit. It would also be practical to have the proximal end portions of the inner and outer tubular members be slightly narrower to create a kind of snap fit when engaged together.

Referring now to FIGS. 20 through 24, the outer tubular member 41 is embedded in a cavity at the distal rear end of the fuselage 70 of the strike glider 47. The inner tubular member 45 telescopically juts out from the embedded outer tubular member 41. The amplification of the strike is achieved by a depressible bias between the two slidable tubular components as shown in FIG. 24. The biasing member in the form of the coil spring member 33 provide expansion of the connected tubular members away from each other. The abrupt release of the tensile load from the compressed coil spring 33 as the glider is thrusted away from the point of impact will empower the glider toy 47 with an additional thrusting jolt forward after the strike to the booster bumper component 27.

In previous embodiments a strike launch operation entails a singular strike to an inert, immobilized booster tail component attached to or integrally formed from the main body itself to propel the strike glider toy in a first direction into flight. The fully extended strike surface at the distal end of the inner tubular member 45 represent a starting position that precedes a second actuating position.

FIGS. 23 and 24 illustrates the independent mobility of the booster bumper strike surface 27 relative to that of the glider. In operation, this multi-part protractible booster tail assembly unit 65 requires a sequence of thrusting actions to propel the strike-responsive glider from the ground into flight. A strike to the rear booster bumper 27 will cause the telescopically and slidably fitted inner tubular protuberant member 45 into a retracted position allowing the bumper 27 to impact the rear of the glider's fuselage 70, which is considered the second actuating position, and empower the inner coil spring 33 to contract and promptly release its tensile load to abruptly and forcefully extend the encapsulated outer tubular member 41 outward to augment the forward projection of the glider toy 47 after the initial strike.

The detached protractible booster tail assembly unit of FIG. 25 illustrates a slightly alternate embodiment of the of the apparatus. In this alteration the two protractible tubing components 41, 45 can be locked in a contracted position with the booster bumper 27 abutted to the rear of the glider as seen in like manner to FIGS. 21 and 24. This reduces the overall length of the glider and would be the preferred position for storage, shipping, or commercial display. In this locked position abutting the rear of the glider, the booster bumper 27 component will can function in much the same way as the previous illustrated surface to surface fuselage confined booster tail components having relatively little amplified thrusting capacity as shown in FIG. 6 for example.

The tubular members of FIG. 25. are constructed so that the tubing members can be interlocked with a twisting action and the two mated portions can operate cooperatively as shown in FIG. 26. The outer tubular member is sized to receive a portion of the smaller diameter of the inner tubular member. The outer tubular member having a cylindrical wall opening 31 suitable to accommodate a nub 37 from the outer surface of the inner tubular member. By aligning the nub 37 up with the cylindrical wall opening 31 of the outer tubular member 41 and thus pushing the nub 37 into the wall opening 31 and twisting vertically to snap the nub in position into a stop hole 35 will effectively lock the booster bumper 27 to the rear surface 70 of the fuselage. Therefore, the embodiment of FIG. 65*s* particularly relates to the method of locking a protractible booster tail component, or equivalent, against the rear of the glider upon proper manipulation of supporting apparatus in a contracted position when desired and unlocking back to a protractible extended position.

This protractible booster tail assembly unit 65 innovation of the strike flight glider toy is also conformable to the more conventional cylindrical type glider configurations such as illustrated in FIG. 27 and not to exclude a glider that operate in an appendagelessly, ballistic, rocket like style as well. Furthermore, the protractible booster tail assembly unit 65 can be adapted to rolling vehicle toys such as a rollable toy airplane with wheels or a simple toy car as shown in FIGS. 28 and 29 which illustrate a top and bottom view of a toy vehicle that can be thrusted into a rolling motion by impacting a rearwardly attached protractible booster tail assembly unit 65.

Turning now to FIG. 30 and the impact device of glider toy 101 which feature a very different and less elaborate type of protractible booster tail as the forementioned unit of 65. A bellows like expandable vessel composed of resilient helical coil convolutions or like in manner, to form a hollow air chamber of a type of booster bellows. The booster bellows device 51 is operable for translational movement under a user provide biasing force. In a preferred operation of the protractible booster bellows device 51, a forceful precursory contraction of the impact surface 71 precedes the strike launch of the glider.

There are many desirable characteristics that would make a bellows style booster tail an exceptional choice to launch a strike-initiated glider toy. The accordion-like shape allows the bellows 51 to collapse when compressed by exterior pressure, and like a coil spring, a bellows has an inherent restorative force to extend back to its approximate prior and/or initial reset position when there is no longer a compressive force acting on the bellows.

The air that permeates the hollow chamber of the protractible booster bellows device 51 allows it to contract when compressed. The compression on the exterior causes the air to be pressurized and become a thrusting bunt force exertion against the rear of the glider toy to launch it into flight. The convolutions collapses to release air or expand to take in air. The release of pressure on the bellows as the glider moves away from the impact force allows it to retract to its previous extended shape.

The booster bellows 51 has a close end 71 which serve as the surface to be impacted with a strike. An open end with a perimeter lip 73. The open-end lip 73 is inserted into an inner cavity 53 at the rear of the strike flight glider 101. A frictional fit between the lip end 73 of the booster bellows 51 and the wall of the inner cavity 53 secures the bellows in place, and of course many other suitable means can be used to secure the bellows in place as well such as adhesive means. Air will naturally circulate into and out of the booster bellows 51 into the inner cavity 53 as it contracts and retracts from a user provided impact force. A forceful strike to the booster bellows 51 with a kick or with an instrument such a club or mallet will compress the bellows and in turn pressurized the confined air in those hollow areas to generate a burst of bunt force exertion against the rear of the glider to propel it in a first direction into flight from a ground launch operation. Flight distances to be achieved is generally dependent on the impact force applied to contract the bellows. Furthermore, the protractible booster bellows device 51 can be adapted to simple rolling toys with wheels like cars, trucks, or any suitable plaything with wheels that can be thrusted into a rolling motion by impacting a rearwardly attached protractible booster bellows device 51 such as seen in FIG. 33.

The present invention presents a glider offering many improvements over prior art glider toys and advances the genre to greater heights and sets forth refinements in use and operation never before ascertained. The structural details of the novel features illustrated in the preferred embodiments describe a rugged and versatile glider toy capable of a wide range of predicable performance when thrusted into flight from a ground level position. According, the afore described embodiments are intended for the purposes of illustration and not as limitation. It is obvious that numerous additions, changes, and omissions maybe made in the embodiments without departing from the spirit and scope of the invention.

I claim:

1. A strike flight glider toy configured to be impacted on a rear impact surface by a user provided launch force to propel the glider toy into airborne or amphibious flight, the glider toy comprising:

a main body comprising a solitary core molded from a single solid piece of foam or plastic material, the main body defined by a perimeter edge, the main body having a top surface, a bottom surface, a front surface, and a rear surface, wherein the main body is elongate, flat, and shaped as a wing capable of amphibious flight or levitating during flight above a ground surface with or without attachable aerodynamic appendages;

at least one booster tail extending from the rear surface of the main body, the booster tail having a thrust receiving surface laterally disposed and attached to the rear surface of the main body, the rear wall formed of a resilient material to form a resilient point of impact which protects the main body from damage and to propel the glider toy into flight from the user provided launch force;

at least one ballast counterweight element integrally formed within or removably coupled to the main body to provide increased weight and stability;

a detachable protective shock absorbing nose guard attached to the front surface of the main body, the nose guard formed of a resilient rubber or plastic material to absorb impact forces and resist deformation;

at least one first wing attached to and extending outwardly from a left side surface of the main body and a second wing attached to and extending outwardly from a right side surface of the main body, wherein the wings are detachably coupled to the main body so that the main body may be used as a wingless projectile or as an aquatic swim aid; and at least one hydrodynamic or aerodynamic appendage connected to and extending outward from the main body or connected to and extending outwardly from said first wing and said second wing to provide stability and direct the glider toy through air and water;

wherein, in a first mode of operation, a user aligns the front surface of the main body in a first direction and provides an impact force to the booster tail to thrust the glider toy to launch and fly through air or water in the first direction.

2. The strike flight glider toy of claim 1, wherein the main body and all subjoined appendages including the booster tail are sustained entirely by confined air such that the main body, attached appendages, and booster tail are inflatable.

3. The strike flight glider toy of claim 1, wherein the main body further comprises an outer elastomeric shell forming a durable protective skin to encase the core.

4. The strike flight glider toy of claim 3, wherein the shell is formed as a decorative cover having graphics printed thereon.

5. The strike flight glider toy of claim 4, wherein the shell further comprises raised and/or recessed surface texture capable of altering aerodynamic properties of the glider toy in flight.

6. The strike flight glider toy of claim 3, wherein the main body is tapered in shape from the front surface to the rear surface to form a centrally located booster tail surface at the rear surface.

7. The strike flight glider toy of claim 6 wherein the booster tail is in the form of an elongated protrusion integrally formed with the main body or an inflexibly transfixed surface separately attached to the rear surface.

8. The strike flight glider toy of claim 1, wherein the bottom surface of the main body further comprises at least one wheel or retractable support member configured to allow selective ground surface contact and to elevate the main body above the ground surface.

9. The strike flight glider toy of claim 1, wherein the at least one booster tail is interchangeable and replaceable with another booster tail, and wherein the at least one booster tail comprises a hollow booster tail filled with air.

10. The strike flight glider toy of claim 1 wherein at least one counterweight element is removably embedded within the core of the main body.

11. A strike flight glider toy configured to be impacted on a rear impact surface by a user provided launch force to propel the glider toy into airborne or amphibious flight, the glider toy comprising:

a main body comprising a solitary core molded from a single solid piece of foam or plastic material, the main body defined by a perimeter edge, the main body having a top surface, a bottom surface, a front surface, and a rear surface, wherein the main body is elongate, flat, and shaped as a wing capable of amphibious flight or levitating during flight above a ground surface with or without attachable aerodynamic appendages;

at least one booster tail bumper extending from the rear surface of the main body, the booster tail bumper having a thrust receiving strike surface, the booster tail bumper operable for independent translational movement under a biasing force relative to the main body;

at least one ballast counterweight element integrally formed within or removably coupled to the main body to provide increased weight and stability;

a detachable protective shock absorbing nose guard attached to the front surface of the main body, the nose guard formed of a resilient rubber or plastic material to absorb impact forces and resist deformation;

at least one first wing attached to and extending outwardly from a left side surface of the main body and a second wing attached to and extending outwardly from a right side surface of the main body, wherein the wings are detachably coupled to the main body so that the main body may be used as a wingless projectile or as an aquatic swim aid; and at least one hydrodynamic or aerodynamic appendage connected to and extending outward from the main body or connected to and extending outwardly from said first wing and said second wing to provide stability and direct the glider toy through air and water;

wherein, in a first mode of operation, a user aligns the front surface of the main body in a first direction and provides an impact force to the booster tail bumper to contract against the rear surface of the main body and thrust the glider toy to launch and fly through air or water in the first direction.

12. The strike flight glider toy of claim 11 wherein the booster tail bumper is distally attached to a protractible assembly unit to give an additional thrusting boost to the glider toy upon launch into flight.

13. The strike flight glider toy of claim 12 wherein the protractible assembly unit further comprises two telescoping tubular members biased by an inner coil spring.

14. The strike flight glider toy of claim 13 further comprising a locking mechanism for releasably locking the two telescoping tubular members in a contracted position with the booster tail bumper strike surface abutting the rear surface of the glider toy.

15. The strike flight glider toy of claim 12 wherein a protractible assembly unit including wheels is adaptable to move between a glider configuration and a rolling configuration.

16. A strike flight glider toy configured to be impacted on a rear impact surface by a user provided launch force to propel the glider toy into airborne or amphibious flight, the glider toy comprising:

a main body comprising a solitary core molded from a single solid piece of foam or plastic material, the main body defined by a perimeter edge, the main body having a top surface, a bottom surface, a front surface, and a rear surface, wherein the main body is elongate, flat, and shaped as a wing capable of amphibious flight or levitating during flight above a ground surface with or without attachable aerodynamic appendages;

a protractible bellows extending from the rear surface of the main body, the protractible bellows having a thrust receiving surface, the protractible bellows formed of a resilient material to form a resilient point of impact which protects the main body from damage and to propel the glider toy into flight from the user provided launch force;

at least one ballast counterweight element integrally formed within or removably coupled to the main body to provide increased weight and stability;

a detachable protective shock absorbing nose guard attached to the front surface of the main body, the nose guard formed of a resilient rubber or plastic material to absorb impact forces and resist deformation;

at least one first wing attached to and extending outwardly from a left side surface of the main body and a second wing attached to and extending outwardly from a right side surface of the main body, wherein the wings are detachably coupled to the main body so that the main body may be used as a wingless projectile or as an aquatic swim aid; and at least one hydrodynamic or aerodynamic appendage connected to and extending outward from the main body or connected to and extending outwardly from said first wing and said second wing to provide stability and direct the glider toy through air and water;

wherein, in a first mode of operation, a user aligns the front surface of the main body in a first direction and provides an impact force to the protractible bellows to thrust the glider toy to launch and fly through air or water in the first direction.

17. The strike flight glider toy of claim 16 wherein the protractible bellows comprises a closed end forming the thrust receiving surface and an open end.

18. The strike flight glider toy of claim 17 wherein the open end is attached in a cavity at the rear surface of the glider toy.

19. The strike flight glider toy of claim 18 wherein the protractible bellows is resilient to rebound from collapse after being forcibly impacted under a biasing force by a user.

20. The strike flight glider toy of claim 19 wherein the main body further comprises a retractable support member having at least one wheel configured to allow selective ground surface contact and to elevate the main body above a ground surface, wherein the protractible bellows provides the thrusting force to launch the glider toy in the first direction by rolling the at least one wheel along the ground surface.

* * * * *